US011236891B1

(12) United States Patent
Zhang

(10) Patent No.: US 11,236,891 B1
(45) Date of Patent: Feb. 1, 2022

(54) FIXTURE FOLDING HOOK

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 17/211,082

(22) Filed: Mar. 24, 2021

(51) Int. Cl.
*F21V 21/04* (2006.01)
*E04B 9/00* (2006.01)

(52) U.S. Cl.
CPC ..... *F21V 21/048* (2013.01); *E04B 9/006* (2013.01)

(58) Field of Classification Search
CPC ..... E04B 9/006
See application file for complete search history.

(56) References Cited

U.S. PATENT DOCUMENTS 3,019,333 A 1/1962 Pascucci
6,059,424 A 5/2000 Kotloff
9,206,948 B1 12/2015 Scribante et al.

*Primary Examiner* — Tsion Tumebo
(74) *Attorney, Agent, or Firm* — Clement Cheng

(57) ABSTRACT

A light fixture folding hook system including a light troffer having a light compartment and a reflector panel. The light troffer has a middle portion and a mounting frame around the middle portion. The mounting frame has a mounting frame front edge, a mounting frame rear edge, a mounting frame right edge, and a mounting frame left edge. Four folding hooks include a front right folding hook and front left folding hook mounted to the troffer front edge, plus a rear right folding hook and a rear left folding hook mounted to the troffer rear edge. The folding hook panels retain each of the folding hooks at a folding hook pivot. The folding hooks each have a folding hook horizontal section and a folding hook vertical section.

13 Claims, 4 Drawing Sheets

FIXTURE FOLDING HOOK

FIELD OF THE INVENTION

The present invention is in the field of light fixture attachment systems.

DISCUSSION OF RELATED ART

A variety of different light fixtures are attached to external structure during installation or retrofit. During a retrofit, the new light fixture is often installed into an old light fixture, or an existing overhead structure such as a suspended drop ceiling T track frame. The prior art shows a variety of different ways to mount light fixtures.

For example, in U.S. Pat. No. 3,019,333 entitled Lighting fixture troffer and latch therefor by inventor Julio A Pascucci states, "This invention relates to lighting fixtures and more specifically to a novel and improved trotler particularly adaptable for use with fluorescent lamps and arranged and constructed to facilitate installation in ceiling and other openings without the need for auxiliary mounting means such as yokes and the like."

For example, in the U.S. Pat. No. 6,059,424 entitled Fluorescent lighting fixture by inventor David Hall, published May 9, 2000 the abstract discloses, "A fluorescent light fixture or luminaire having a housing which has hinge assemblies which pivotally support a mounting plate. The hinge assembly allows the mounting plate on which the lamps and ballasts are mounted to be pivoted to a generally vertical service position or latched by detents in a horizontal use position within the housing. The lens frame is also latched by detents and is pivotal to a vertical position for access to the housing interior. A selected number of lamp sockets can be selectively secured to the plate to receive the lamps. Reflectors and lamp stand-offs may be secured to the mounting plate at bendable tabs formed in the mounting plate. The light fixture is adapted for use with standard or high efficiency compact lamps."

For example, in the U.S. Pat. No. 9,206,948 entitled Troffer light fixture retrofit systems and methods by inventor John Scribante, published Dec. 8, 2015 the abstract discloses, "A retrofitting kit for retrofitting an existing troffer light fixture having a troffer housing. The kit includes an adaptor bracket and a door assembly. The adaptor bracket includes a channel configured to rest on a T-bar of a ceiling system between the T-bar and the troffer housing, a slot configured to receive a portion of a troffer door assembly, and a latch surface configured to engage with a latch. The door assembly includes a latch configured to engage the latch surface of the adaptor bracket, a hinge configured to interface with the slot of the adaptor bracket, a housing including the latch and the hinge, and a light source within the housing."

SUMMARY OF THE INVENTION

A light fixture folding hook system including a light troffer having a light compartment and a reflector panel. The light troffer has a middle portion and a mounting frame around the middle portion. The mounting frame has a mounting frame front edge, a mounting frame rear edge, a mounting frame right edge, and a mounting frame left edge. Four folding hooks include a front right folding hook and front left folding hook mounted to the troffer front edge, plus a rear right folding hook and a rear left folding hook mounted to the troffer rear edge. The folding hook panels retain each of the folding hooks at a folding hook pivot. The folding hooks each have a folding hook horizontal section and a folding hook vertical section.

Each folding hook vertical section has a folding hook engagement edge configured to engage a T-bar vertical support section or other external structure. The folding hook engagement edge is below the folding hook pivot and below the folding hook horizontal section. The middle portion is attached to the mounting frame at a right swivel hook and a left swivel hook. The mounting frame has a plurality of mounting tabs including a front right mounting tab and a rear right mounting tab both formed on the mounting frame right edge; and a front left mounting tab and a rear left mounting tab both formed on the mounting frame left edge.

The light fixture folding hook system optionally has folding hook panels mounted to the mounting frame at folding hook mounting tabs. A folding hook upper gap can be formed between the folding hook horizontal sections and the folding hook panels. A folding hook side gap can be formed between the folding hook vertical sections and the folding hook panels. A folding hook lower gap can be formed between the folding hook engagement edge and the folding hook panels. The middle portion can be formed with the mounting frame or can be attached to the mounting frame during installation as a separate installation step.

The following callout list of elements can be a useful guide in referencing the element numbers of the drawings.

16 Light Troffer Middle Portion
17 Troffer Left Edge
18 Troffer Right Edge
19 Troffer Upper Side
20 Light Troffer
21 Light Compartment
22 Reflector Panel
23 Power Cables
24 Ground Cable
25 Suspension Cable
26 Left Swivel Hook
27 Right Swivel Hook
28 Troffer Front Edge
29 Troffer Rear Edge
30 Folding Hook
31 Front Right Folding Hook
32 Front Left Folding Hook
33 Rear Right Folding Hook
34 Rear Left Folding Hook
40 Troffer Mounting Frame
41 Mounting Frame Rear Edge
42 Mounting Frame Front Edge
43 Mounting Frame Right Edge
44 Mounting Frame Left Edge
45 Front Right Mounting Tab
46 Rear Right Mounting Tab
47 Front Left Mounting Tab
48 Rear Left Mounting Tab
49 Pivot Slot

50 Folding Hook Panel
51 Folding Hook Mounting Tab
52 Folding Hook Pivot
53 Folding Hook Horizontal Section
54 Folding Hook Vertical Section
55 Folding Hook Engagement Edge
56 Folding Hook Upper Gap
57 Folding Hook Side Gap
58 Folding Hook Lower Gap
59 Folding Hook Inside Gap
60 Frame Member

DETAILED DESCRIPTION OF THE PREFERRED EMBODIMENT

Figure 1:
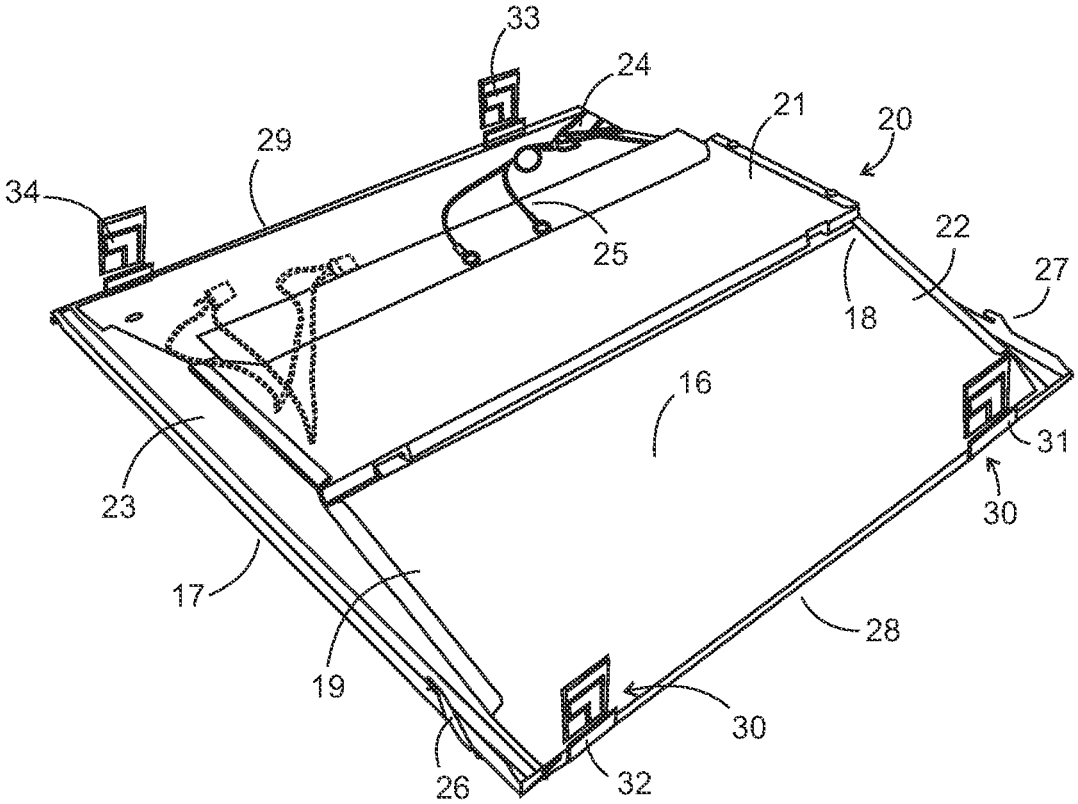
FIG. 1 is a perspective view of a light troffer fixture with a folding hook attachment system.

As seen in FIG. 1, the light troffer 20 generally has a troffer left edge 17, a troffer right edge 18, and a troffer upper side 19. The light compartment 21 is mounted between a pair of reflector panels 22. Power cables 23 and a ground cable 24 provide electrical power to the light-emitting diode overhead light fixture. Preferably, a suspension cable 25 can provide additional support during installation. The light fixture may engage to a frame at a left swivel hook 26 or a right swivel hook 27. The a pair of reflector panels 22 are formed between a troffer front edge 28 and a troffer rear edge 29.

One or more folding hooks 30 can be mounted or integrally formed with the edge of the light troffer 20. For example, the folding hook 30 can be installed at the front right folding hook 31, the front left folding hook 32, the rear right folding hook 33, and the rear left folding hook 34. The four folding hooks 30 can be mounted at four corners of the edges of the light troffer. The folding hooks are preferably made of a sheet of stamped metal having a bendable hook that bends away from an edge of the light fixture so that the hook engages a T-bar track which can be formed as a drop ceiling grid structural system.

Figure 2:
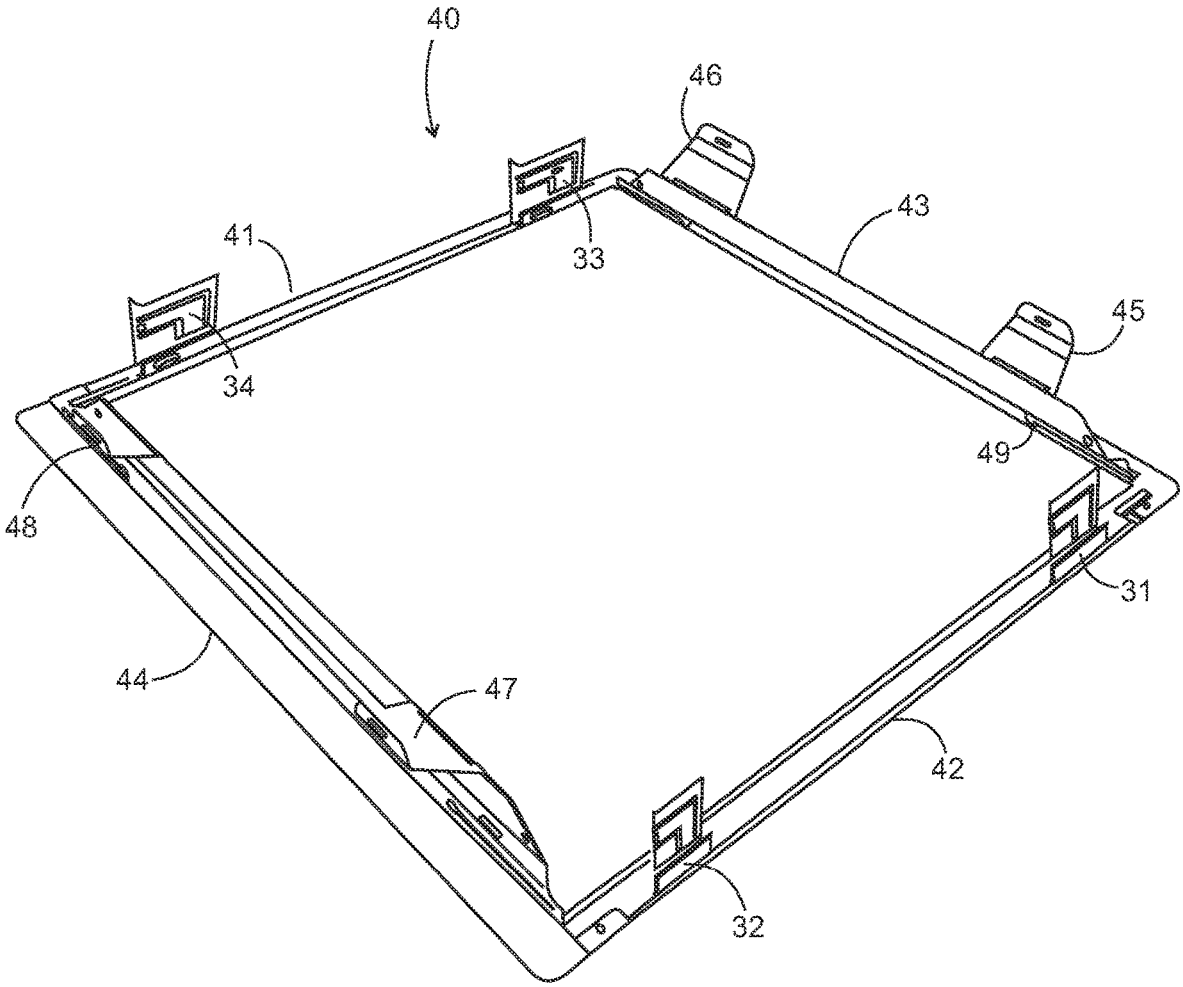
FIG. 2 is a perspective view of a light troffer fixture frame with a folding attachment system

As seen in FIG. 2, the troffer mounting frame 40 can be formed separately from the reflector panel 22. The light troffer 20 can be made of two separate parts, namely the troffer mounting frame 40 being one part, and the light troffer middle portion which includes the light compartment 21 and reflector panels 22. The troffer mounting frame can receive the middle portion of the light troffer 20. The light troffer middle portion can be a rectangular or square member that fits into the troffer mounting frame.

The front right folding hook 31, the front left folding hook 32 extend upwardly from a mounting frame front edge 42. The rear right folding hook 33 and the rear left folding hook 34 extend out from a mounting frame rear edge 41. The troffer mounting frame 40 includes a mounting frame rear edge 41, a mounting frame front edge 42 in a rectangular configuration with a mounting frame right edge 43 and a mounting frame left edge 44. The mounting frame front edge 42 and the mounting frame rear edge 41 connect to the mounting frame right edge 43 and the mounting frame left edge 44.

Optionally, four mounting tabs can be formed on the troffer mounting frame 40. The front right mounting tab 45 and the rear right mounting tab 46 can extend upwardly from the mounting frame right edge 43. The front left mounting tab 47 and the rear left mounting tab 48 can extend upwardly from the mounting frame left edge 44. The mounting tabs can be formed with an opening for receiving a nail for nailing the mounting tabs to external structure. A user can first deploy the folding hooks to stabilize the troffer mounting frame 40, and then nail on the mounting tabs. The user can then install the light compartment 21 to the troffer mounting frame 40.

Preferably, pivot slots 49 formed on the troffer mounting frame 40 are formed on the mounting frame left edge 44 and the mounting frame right edge 43. The pivot slots 49 can receive a swivel pin that engages the pivot slots 49. The swivel pin can be mounted on a a side of the reflector panel or the light compartment.

Figure 3:
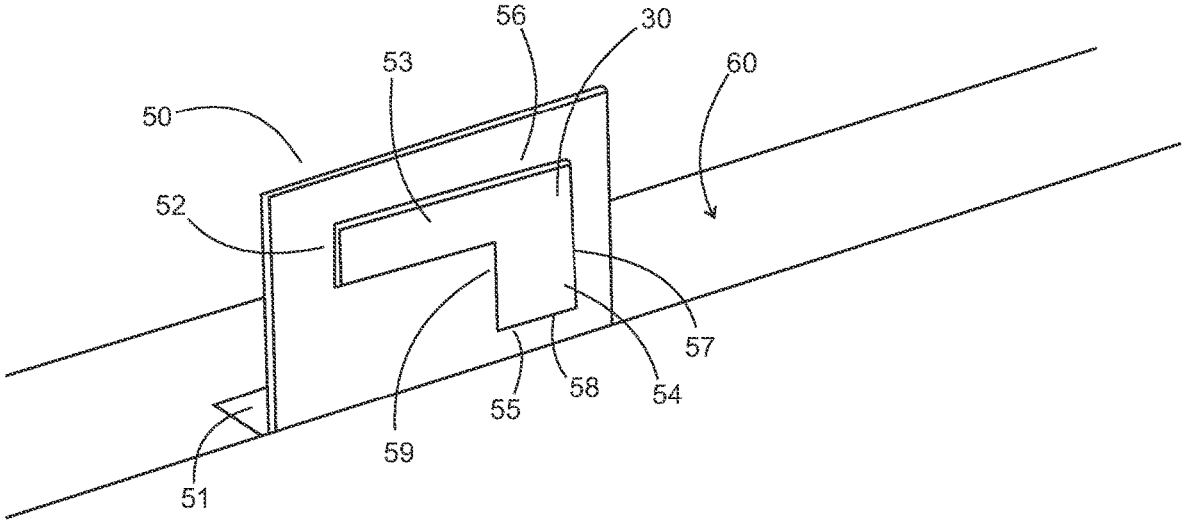
FIG. 3 is a close-up diagram of the folding hook attachment system.

As seen in FIG. 3, the folding hook is formed on a flat sheet of steel that can be stamped and bent to an upright configuration. The folding hook 30 is part of the folding hook panel 50 and is stamped from the folding hook panel 50. The folding hook panel 50 is connected to the frame member 60 at the folding hook mounting tab 51 and can be integrally formed with the frame member 60, or can be connected by connectors or spot welded in place. A folding hook pivot 52 allows a user to bend the folding hook 30 at the folding hook pivot 52.

After being bent outwardly, the folding hook 30 displays a folding hook horizontal section 53 connecting to a folding hook vertical section 54. The folding hook vertical section 54 is bounded between a folding hook side gap 57 and a folding hook inside gap 59. The folding hook horizontal section is bounded by the folding hook upper gap 56 and the folding hook inside gap 59. The folding hook engagement edge 55 engages a T-bar when it is folded out. The folding hook upper gap 56 is parallel to the folding hook horizontal section 53 and defines an upper edge of the folding hook horizontal section 53. The folding hook side gap 57 is parallel to the folding hook vertical section 54 and defines a side edge of the folding hook vertical section 54. The folding hook inside gap 59 has a vertical portion and a horizontal portion that define an inside edge of the folding hook 30. The folding hook engagement edge 55 is parallel to and defined by the folding hook lower gap 58. The frame member 60 is also a sheet metal formed member for receiving the folding hook mounting tab 51.

Figure 4:
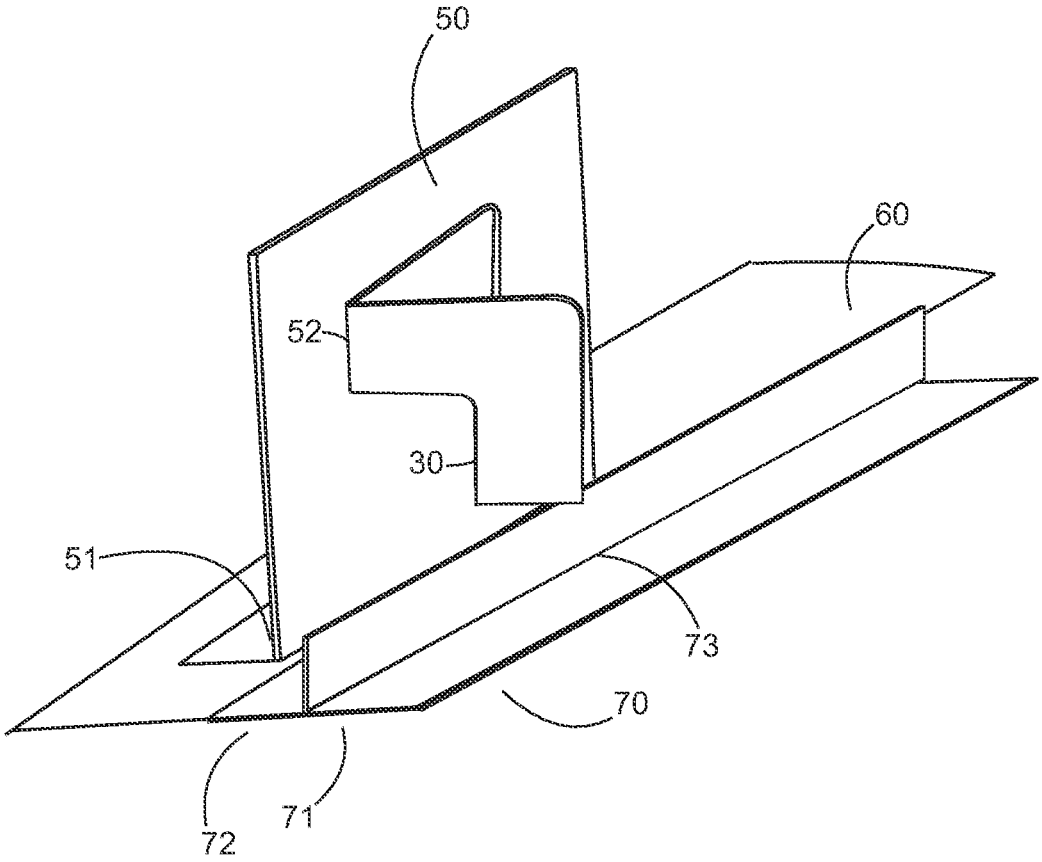
FIG. 4 is a diagram showing the folding hook in an engaged position.

As seen in FIG. 4, folding hook 30 folds outwardly to engage a T-bar support 70. The T-bar support 70 has a T-bar first horizontal support section 71 and a T-bar second horizontal support section 72. The T-bar vertical support section 73 extends outwardly at a midpoint of the T-bar horizontal support. The T-bar support 70 supports the frame member 60 when the folding hook 30 unfolds from the folding hook panel 50. The folding hook mounting tab 51 transmits the support from the folding hook engagement edge 55 to the frame member 60. The folding hook pivot 52 can be scored or indented for easier bending.

The invention claimed is:

1. A light fixture folding hook system comprising:

a. a light troffer having a light compartment and a reflector panel, wherein the light troffer has a middle portion and a mounting frame around the middle portion;

b. wherein the mounting frame has a mounting frame front edge, a mounting frame rear edge, a mounting frame right edge, and a mounting frame left edge;

c. a total four folding hooks include a front right folding hook and front left folding hook mounted to the troffer front edge, plus a rear right folding hook and a rear left folding hook mounted to the troffer rear edge;

d. folding hook panels, wherein the folding hook panels retain each of the folding hooks at a folding hook pivot, wherein the folding hooks each have a folding hook horizontal section and a folding hook vertical section, wherein the folding hook vertical section has a folding hook engagement edge configured to engage a T-bar vertical support section or other external structure, wherein the folding hook engagement edge is below the folding hook pivot and below the folding hook horizontal section.

2. The light fixture folding hook system of claim 1, wherein the middle portion is attached to the mounting frame at a right swivel hook and a left swivel hook.

3. The light fixture folding hook system of claim 1, wherein the mounting frame has a plurality of mounting tabs including a front right mounting tab and a rear right mounting tab both formed on the mounting frame right edge, and including a front left mounting tab and a rear left mounting tab both formed on the mounting frame left edge.

4. The light fixture folding hook system of claim 1, wherein the folding hook panels are mounted to the mounting frame at folding hook mounting tabs.

5. The light fixture folding hook system of claim 1, further including a folding hook upper gap formed between the folding hook horizontal sections and the folding hook panels.

6. The light fixture folding hook system of claim 1, further including a folding hook side gap formed between the folding hook vertical sections and the folding hook panels.

7. The light fixture folding hook system of claim 1, further including a folding hook lower gap formed between the folding hook engagement edge and the folding hook panels.

8. The light fixture folding hook system of claim 1, wherein the middle portion is formed with the mounting frame.

9. The light fixture folding hook system of claim 8, wherein the mounting frame has a plurality of mounting tabs including a front right mounting tab and a rear right mounting tab both formed on the mounting frame right edge, and including a front left mounting tab and a rear left mounting tab both formed on the mounting frame left edge.

10. The light fixture folding hook system of claim 8, wherein the folding hook panels are mounted to the mounting frame at folding hook mounting tabs.

11. The light fixture folding hook system of claim 8, further including a folding hook upper gap formed between the folding hook horizontal sections and the folding hook panels.

12. The light fixture folding hook system of claim 8, further including a folding hook side gap formed between the folding hook vertical sections and the folding hook panels.

13. The light fixture folding hook system of claim 8, further including a folding hook lower gap formed between the folding hook engagement edge and the folding hook panels.

* * * * *